US006310447B1

(12) United States Patent
Krummel

(10) Patent No.: US 6,310,447 B1
(45) Date of Patent: Oct. 30, 2001

(54) METHOD FOR OPERATING AT LEAST ONE FLUORESCENT LAMP, AND ELECTRONIC BALLAST THEREFOR

(75) Inventor: Peter Krummel, Traunreut (DE)

(73) Assignee: Patent Treuhand-Gesellschaft fuer elektrische Gluelampen mbH, Munich (DE)

( * ) Notice: Subject to any disclaimer, the term of this patent is extended or adjusted under 35 U.S.C. 154(b) by 0 days.

(21) Appl. No.: 09/593,381

(22) Filed: Jun. 14, 2000

(30) Foreign Application Priority Data

Jun. 18, 1999 (DE) ..... 199 28 042

(51) Int. Cl.[7] ..... G05F 1/00

(52) U.S. Cl. ..... 315/308; 315/307; 315/360; 315/362; 315/209 R; 315/244; 315/224

(58) Field of Search ..... 315/119, 127, 315/224, 225, 244, 291, 209 R, 307, 308, 360, 362, DIG. 4, DIG. 5, DIG. 7

(56) References Cited

U.S. PATENT DOCUMENTS 5,066,894 * 11/1991 Klier ..... 315/224
5,705,894 * 1/1998 Krummel ..... 315/119
5,729,096 * 3/1998 Liu et al. ..... 315/224
5,747,943 * 5/1998 Houk et al. ..... 315/225

FOREIGN PATENT DOCUMENTS 0 801 881 B1 10/1997 (EP) .

* cited by examiner

*Primary Examiner*—Haissa Philogene
(74) *Attorney, Agent, or Firm*—Carlo S. Bessone

(57) ABSTRACT

An integrated control and regulating circuit (IC) controls, via a half-bridge circuit (V2, V3), a load circuit (4) having the at least one fluorescent lamp (FL) by means of a drive circuit (CCO, SEL, HSD, LSD) regulated in a high-frequency manner. In the control and regulating circuit, each time the lamp is started and/or when there is a disturbance, a timer (PST, IT, CT) is started, which thus defines a sequence predetermined periods of time (Δpt, Δit, Δst, Δot), inter alia preheating period (Δpt) and ignition period (Δit). In a monitoring circuit (MON), the pulsed load current of the load circuit is cyclically monitored in comparison with reference levels (Mp, Mi, Mdo and Mo) which are respectively predetermined for the periods of time, in order to detect a normal state or a disturbance in the load circuit, to control the current regulation of the drive circuit (CCO, ISC, SEL, HSD, LSD) in the normal state, or to trigger an automatic disconnection of the electronic ballast in the event of a disturbance. During the ignition period (Δit), a current signal which is derived from the load current and is fed to the monitoring circuit (MON) has superposed on it an internally generated DC signal (DC) having a defined level. The value thereof is dimensioned in accordance with the types and/or circuits of the fluorescent lamp(s) which are used in the load circuit, with the result that the signal that is superposed in this way is adapted to the predetermined, fixed reference levels (e.g. Mp, Mi) of the monitoring circuit (MON) independently of the lamp selection in the load circuit.

8 Claims, 2 Drawing Sheets

METHOD FOR OPERATING AT LEAST ONE FLUORESCENT LAMP, AND ELECTRONIC BALLAST THEREFOR

TECHNICAL FIELD

The invention relates to a method for operating at least one fluorescent lamp with the aid of an electronic ballast.

I. PRIOR ART

EP-B-0 801 881 discloses such a method for operating at least one fluorescent lamp with the aid of an electronic ballast which has a half-bridge circuit coupled to a rectifier circuit and having two power transistors which are in series with one another and are activated alternatively. A load circuit is connected to the common junction point of said power transistors, which forms the output of the half-bridge arrangement, which load circuit contains the at least one fluorescent lamp and the load current of which load circuit is monitored. To that end, a control and regulating circuit is provided in the form of an integrated circuit. This circuit is equipped with a monitoring circuit for continuously monitoring the load current and with a drive circuit, which is regulated in a high-frequency manner derived therefrom, for the power transistors. In the case of the known ballast, a timer is started in a defined manner each time the lamp is started and each time a disturbance occurs during lit operation, which timer generates a time base for subsequent control and regulation operations. On account of this time base, respectively predetermined, different reference levels for the load current to be detected are set in the monitoring circuit or automatic disconnection of the electronic ballast for a predetermined, limited period of time is prepared. The monitoring circuit compares the instantaneous value of the load current with the respectively activated reference level and emits a respective output pulse once this reference level has been reached. These output pulses identify normal or alternatively faulty states in the load circuit as a function of their occurrence or failure to occur during predetermined periods of time defined by the timer. By means of these output pulses, the lamp current is regulated as a function of time via the regulated drive circuit in the event of an undisturbed operating state, or an already prepared automatic disconnection of the electronic ballast is triggered in the case of a fault.

Fully electronic ballasts of the type mentioned are universal devices which can be used advantageously for conventional AC power supply voltages in a relatively broad tolerance range, a broad range of permissible power supply frequencies and, finally, are even suitable for DC voltage supply. However, one of the essential problems having to do with the application of electronic ballasts is that use is made of different lamp types in circuits which also vary in some instances, e.g. including a plurality of fluorescent lamps, which brings about a corresponding type diversity of the ballasts which are specifically adapted to these applications. It is no easy matter, therefore, to comply with this type diversity by means of as far as possible a single large scale integrated circuit in which the drive and regulating circuit of the ballast is combined. As a compromise, with an intrinsically desirable high integration level partly being obviated, corresponding control inputs of the integrated circuit are adapted by externally connected components.

Thus, by way of an example, in the case of the electronic ballast described above, the magnitude of the ignition voltage is not freely adjustable, since this is determined by a fixed threshold value defined internally in the integrated circuit. In the case of the known electronic ballast, too, the adaptation of the ignition and/or preheating voltage that is permissible within the scope of a tolerance range that is still manifested, which adaptation is necessary for different applications can at best be achieved by corresponding external circuitry of the integrated circuit and, for that reason, then only with a corresponding outlay.

II. SUMMARY OF THE INVENTION

Therefore, one sub-object underlying the present invention is, in a development of the method for operating at least one fluorescent lamp as mentioned in the introduction, to specify a further embodiment which, in addition to reliable regulation of the load current, even in the case of aged fluorescent lamps, in particular opens up the possibility of reliably controlling even those applications in which lamp types having a critical ignition behavior are intended to be used.

A further sub-object underlying the present invention is to develop the electronic ballast of the type acknowledged above in such a way that, despite a corresponding integration level of its drive and regulating circuit and thus reduced outlay for the external circuitry, it can be used to a broad extent reliably in a wide variety of applications merely by simple adaptation.

The solutions according to the invention enable a simple measure to be employed to extend the tolerance range of the electronic ballast with regard to the monitoring of the load current. This property is advantageous particularly when the load circuit comprises a lamp circuit having a plurality of fluorescent lamps. In the case of such lamp circuits, and also in the case of fluorescent lamps having a critical ignition behavior, it is difficult to reliably control the tolerance range by means of a given integrated circuit. In the integrated circuit, tolerance ranges cannot readily be predetermined with sufficient breadth, because any critical operating states, such as e.g. reluctance to ignite and/or ignition failures in the case of aged fluorescent lamps, are then no longer detected in an entirely satisfactory manner. Another possibility, mainly that of equipping the electronic ballast with a predetermined integrated control and regulating circuit and nevertheless operating even such critical lamp circuits therewith, would consist in adapting, with a degree of effort, the external circuitry of the integrated circuit to the respective application. In view of the fact that electronic ballasts are nowadays products which, under high cost pressure, largely have to be produced in an automated fashion, such a solution is uneconomical.

According to the invention, this problem is solved in an elegant manner by means of a relatively simple circuit measure. The load current signal that is to be monitored in the control and regulating circuit has superposed on it a DC signal from an additional DC source, the level of which DC signal is adjustable in a manner dependent on the lamp circuit respectively used. Since the preheating voltage and in particular the ignition voltage are critical in these applications that are difficult to control, it suffices to provide this superposition merely for the ignition period which begins at the end of the preheating period.

As specified in subclaims, the level adaptation of the additional DC source can be achieved using simple means and reliably by virtue of the fact that the level to be set is derived internally from the current flow through the adaptation resistor, which, as an external resistor, is assigned to the oscillator which is controlled in a current-dependent manner, and the blanking interval of the half-bridge circuit is defined by the dimensioning of said resistor. A circuit adaptation to different lamp circuits in the load circuit can thus be performed by the corresponding dimensioning of a single non-reactive resistor.

In a development of the solution according to the invention, it is particularly advantageous if the load current regulation that is absolutely necessary for individual operating states of the electronic ballast is deactivated occasionally and insofar as the current limiting is canceled during the ignition period. To that end, a further threshold is provided in the monitoring circuit, the level of which further threshold lies between those for the preheating threshold and the ignition threshold. The further output pulses that are emitted by the monitoring circuit during the evaluation of the load current signal with regard to said further threshold set an inhibiting switch, which is cyclically reset and, in the activated state, in each case interrupts the current regulation via the oscillator which is controlled in a current-dependent manner.

BRIEF DESCRIPTION OF THE DRAWINGS

Further details and advantages of the solution according to the invention can be gathered from the following description of exemplary embodiments, which is given with reference to the drawing, in which.

DETAILED DESCRIPTION OF THE INVENTION

Figure 1:
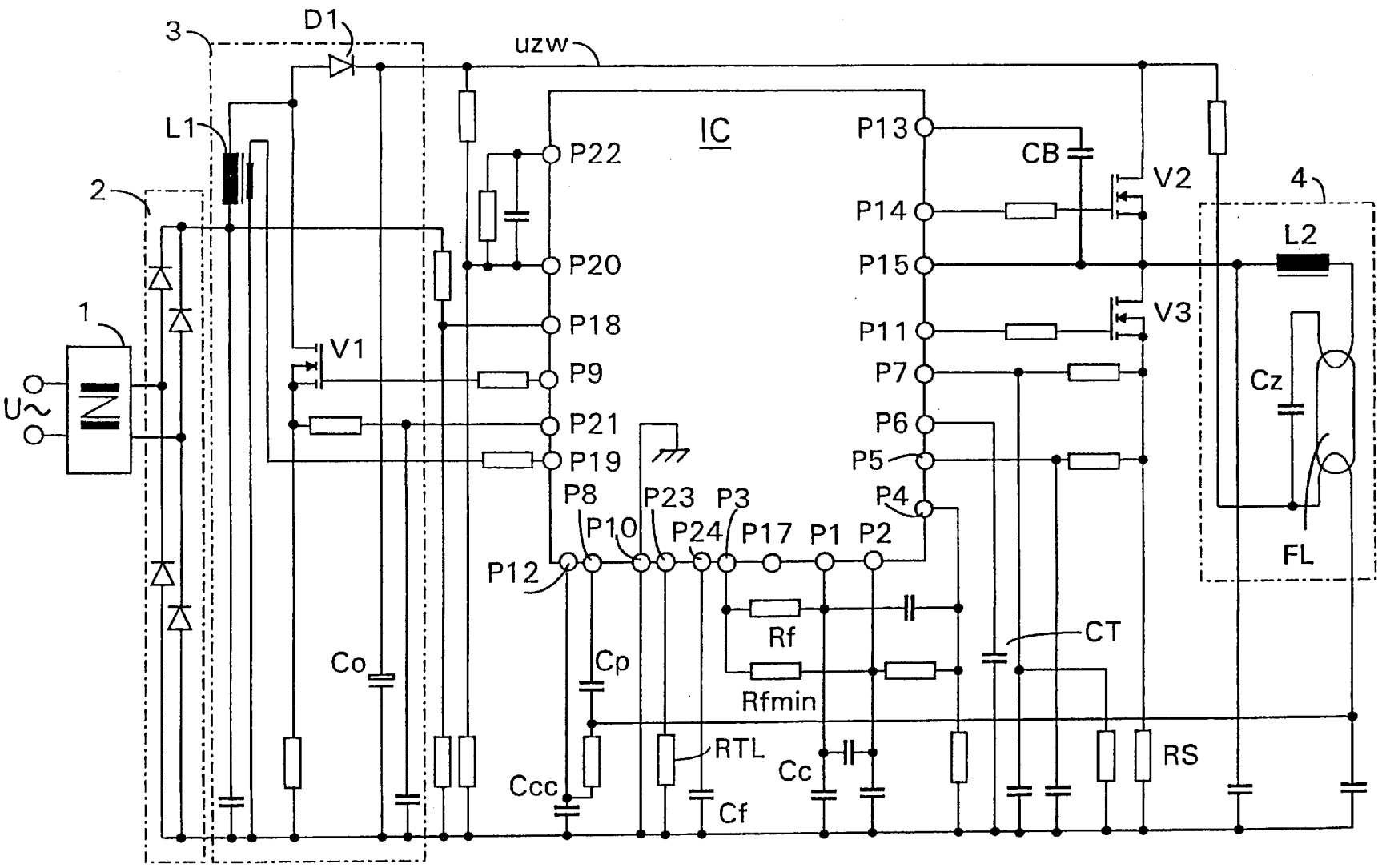
FIG. 1 shows a block diagram of an electronic ballast with a load circuit connected thereto, where a control and regulating circuit of the electronic ballast is designed as an integrated circuit and is merely illustrated schematically.

FIG. 1 illustrates an electronic ballast for operating at least one fluorescent lamp, as well as the actual load circuit, by way of example having only one fluorescent lamp in this case. The electronic ballast that is illustrated in based on an electronic ballast which, in terms of its basic structure and a plurality of circuit details, is already disclosed in the document EP-B-0 801 881 mentioned in the introduction, to which reference can be made here. Known circuit sections and the functioning thereof which are of secondary importance in connection with the present invention are, therefore, only summarized below and outlined for reasons of completeness.

A radio frequency filter 1, a rectifier bridge 2 and also a step-up converter 3, which has a charging inductor L1, a charging diode D1, a first power transistor V1 and, as output stage, a storage capacitor Co, are connected to AC voltage u≈. The power transistor V1 is driven via a control and regulating circuit IC designed as an integrated circuit. At its output, the step-up converter 3 provides a stabilized DC voltage, the so-called intermediate circuit voltage uzw, which is stepped up in comparison with the rectified power supply voltage. Furthermore, provision is made of an inverter with a half-bridge circuit, which is realized here in particular by two further power transistors V2 and V3, situated in series in parallel with the output of the step-up converter 3, and also a bridge Capacitor CB. A load circuit 4, illustrated here with a further inductor L2, a fluorescent lamp FL and an ignition capacitor Cz, is connected to the output of the half-bridge circuit V2, V3.

All the essential control and regulation functions of the electronic ballast are realized in the control and regulating circuit IC. For reasons of clarity, the control and regulating circuit IC is illustrated merely as a module with external terminals P1 to P24, to which external components are connected, in FIG. 1 and is illustrated in more detail to supplement that in the form of a block diagram in FIG. 2.

Figure 2:
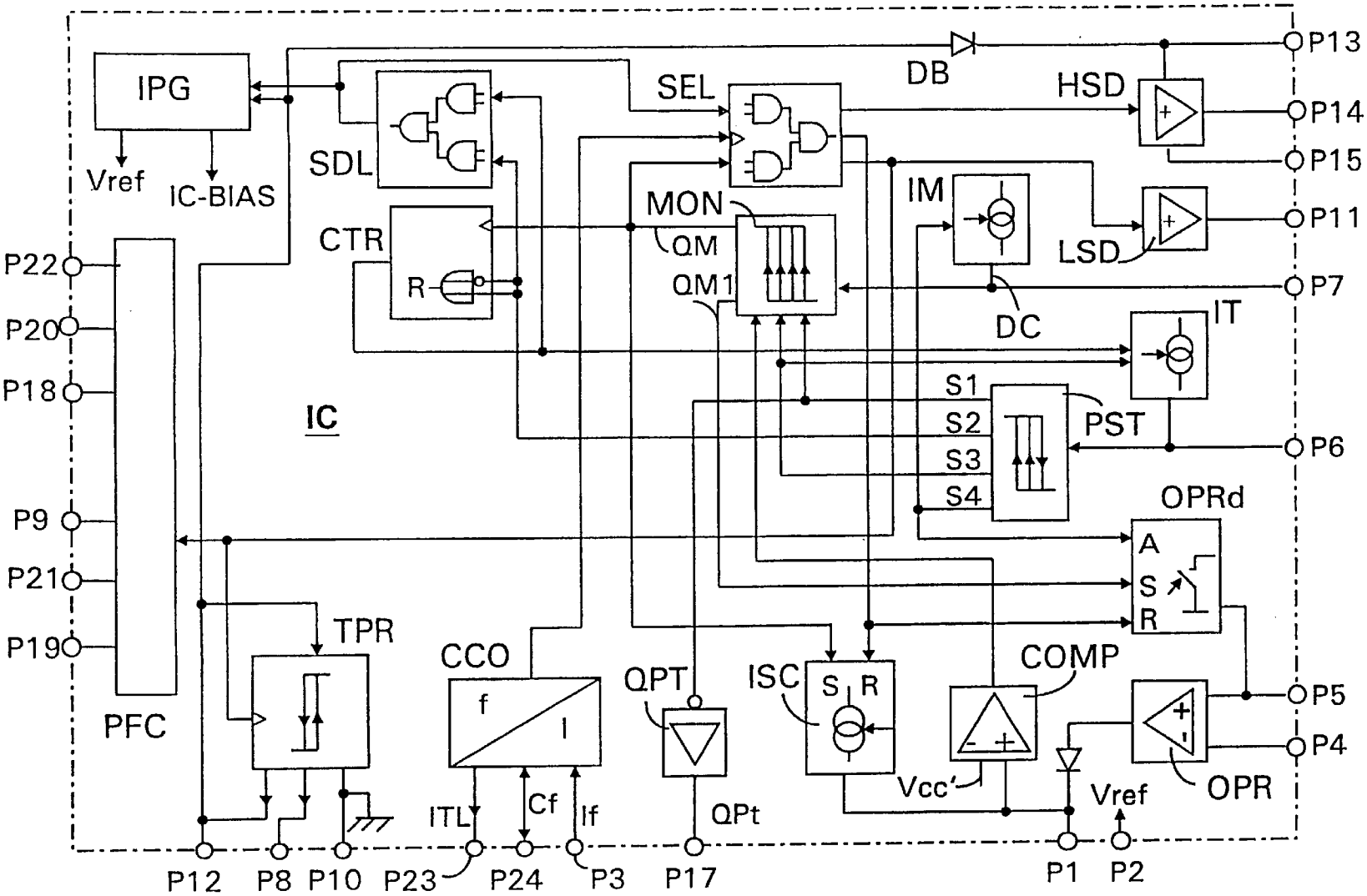
FIG. 2 shows further details of the structure of the control and regulating circuit of the electronic ballast.

In practical use, a defined power supply of the control and regulating circuit IC is of considerable importance; in the present case, however, this can be assumed to be already known. Therefore, FIG. 2 schematically illustrates, in a simplified manner, a power supply unit IPG, which ensures entirely satisfactory starting of the functions of the control and regulating circuit IC and, to that end, is controlled by the charge state of an externally connected charging capacitor Ccc. In the steady-state condition, the power supply of the control and regulating circuit IC is provided via a pumping diode DB, connected to the bridge capacitor CB, with a further external charging capacitor Cp by means of a two-point regulator TPR. The power supply unit IPG generates an internal auxiliary voltage IC-BIAS for supplying the internal circuit units of the control and regulating circuit IC and furthermore supplies a reference voltage Vref. Furthermore, this only being pointed out, the control and regulating circuit IC contains an arrangement PFC for controlling the power factor.

Further control and regulation functions of the control and regulating circuit IC are also already known per se. Thus, a drive circuit for the half-bridge circuit V2, V3 comprises a selection circuit SEL and driver circuits HSD and LSD, respectively, connected thereto. A high-frequency pulse train is fed in at a control input of the selection circuit SEL, which, via the driver circuits HSD and LSD, respectively, turns on the power transistors V2 and V3 of the half-bridge circuit after the manner of a flip-flop alternatively with a defined blanking interval.

This controlling pulse train is supplied by an oscillator CCO which is controlled in a current-dependent manner and has three setting inputs corresponding to the external terminals P23, P24 and P3. A first variable resistor RTL is connected to the terminal P23 and its dimensioning defines, in particular, the blanking interval of the power transistors V2 and V3 of the half-bridge circuit. A variable capacitor Cf is connected to the further external terminal P24. The third terminal of the oscillator CCO, connected to the external terminal P3, is connected to a high-resistance filter network, in particular formed by non-reactive resistors Rf and Rfmin and also a further variable capacitor Cc. The abovementioned external elements and/or the filter network are connected at the other end to ground or else to a defined reference voltage (by way of example, the further description will always refer to ground here). The dimensioning of these external components defines the lower and the upper limiting frequency, respectively, of the oscillator CCO which is controlled in a current-dependent manner and the size of the abovementioned blanking interval. A control signal is fed via the high-resistance filter network to the oscillator CCO which is controlled in a current-dependent manner, said control signal determining the instantaneous frequency of said oscillator. This control signal is generated by a regulating operational amplifier OPR. The latter compares the reference voltage Vref that is generated internally with a second input voltage, which is fed in via the external terminal P5 and corresponds to the average value of the current flowing through the half-bridge circuit V2, V3.

The above-described oscillator circuit constitutes a closed regulating circuit for regulating the load current flowing in the half-bridge circuit. A rising load current increases the output voltage of the regulating operational amplifier OPR, which in turn controls the oscillator CCO toward a higher pulse repetition frequency. However, this frequency increase effects, for its part, a reduction in the load current. The same applies analogously to the opposite direction, for a decreasing trend of the load current. The electronic ballast is also dimmable by means of the reference voltage Vref being defined correspondingly.

Furthermore, a monitoring function is implemented in the control and regulating circuit IC in order to control starting of the lamp, to monitor the state of the fluorescent lamp FL during steady-state operation, and also to identify any disturbances that occur. To that end, provision is made, on the one hand, of a monitoring circuit MON, which continuously monitors the load current, that is to say the current flowing through the half-bridge circuit V2, V3, and, on the other hand, of a timer PST, which provides a time base for this monitoring operation.

A first internal current source IC is connected via the external terminal P6 to a further charging capacitor CT connected to ground. It is activated at the start of the electronic ballast and charges the external charging capacitor CT. A signal voltage which rises linearly up to a final value is formed in the process at the external terminal P6, which signal voltage is fed to the control input of the timer PST and provides the time base for the latter. To that end, said signal voltage is compared with predetermined threshold values in the timer PST. When the respective threshold value is reached, the timer PST outputs a respective selection signal S1, S2, S3 or S4 and defines, with the temporal sequence thereof, specific time segments for preheating, ignition, subsequent normal operation of the fluorescent lamp FL and for resetting its driving in the event of faults that occur, in particular in the event of ignition failures or a lasting reluctance to ignite. The meaning of the selection signals S1 to S4 generated by the timer PST will be examined in connection with the function of the monitoring circuit MON.

The monitoring circuit MON has a signal input which is connected via the external terminal P7 and a series resistor to the output, at low level, of the half-bridge circuit V2, V3. Consequently, the input signal fed via the latter to the monitoring circuit MON is a pulsed signal which is proportional to the current flowing through the power transistor V3, that is to say also proportional to the load current. This signal has superposed on it, as DC bias voltage, the output signal of a further internal current source IM, which is activated occasionally by the selection signal S3 of the timer PST. The level of the bias voltage signal DC generated by said second internal current source IM is derived from the current flow through the variable resistor RTL of the oscillator CCO which is controlled in a current-dependent manner. To that end, internally within the IC by means of current mirrors, part of the current flowing through the variable resistor RTL is fed to the further internal current source IM.

Consequently, by way of the dimensioning of said external variable resistor RTL, without internal adaptation or additional external terminals of the control and regulating circuit IC, it is possible to adapt the monitoring function of the monitoring circuit MON to variants of the configuration of the load circuit 4, in particular specific lamp types and/or lamp circuits. To put it another way, this measure makes it possible, despite fixedly predetermined response thresholds of the monitoring circuit MON for the preheating and/or ignition voltage, to specifically configure this monitoring function for the individual application by way of the dimensioning of the variable resistor RTL. As a result, without internal adaptations, the control and regulating circuit IC can be used for a broad range of circuit alternatives of the load circuit 4; in particular, tolerances for the ignition current in specific lamp types can also be better absorbed.

In principle, one of a plurality of predetermined threshold values for the load current to be monitored is in each case activated in a defined manner in the monitoring circuit MON at specific periods when a lamp is started and also during normal lit operation. As soon as the level of the input signal of the monitoring circuit MON reaches the instantaneously activated threshold value, said monitoring circuit emits an output pulse QM. In the progression over time, this produces a sequence of momentary output pulses QM which each trigger control operations in further units of the control and regulating circuit IC.

This relates, inter alia, to a further regulating circuit for current regulation. For this purpose, provision is made of a third internal current source ISC, the output of which is connected via the external terminal P1 to the external low-pass filter already explained. After the manner of a flip-flop, the third internal current source ISC is respectively set by the output pulses QM of the monitoring circuit MON and reset by the selection circuit SEL. Consequently, the third internal current source ISC charges the external capacitor Cc of the low-pass filter. In a manner proportional to the charging of the external charging capacitor Cc, the input current If changes, which is fed to the oscillator CCO, which is controlled in a current-dependent manner, at its control input via the external terminal P3. In this way, a further closed regulating circuit is provided, which regulates the load current cycle by cycle to the respectively predetermined value which is defined by the instantaneously activated threshold value of the monitoring circuit MON. This second regulating circuit is superordinate to the current regulation described in the introduction for steady-state operation; it limits and regulates the load current during starting of the lamp and also in the event of detected cases of disturbances.

In context, the function of the monitoring circuit MON can be illustrated most clearly with reference to the sequence control during starting of the lamp. If the electronic ballast is connected to the electricity supply, the control and regulating circuit IC is activated, as described, as soon as the switch-on threshold has been reached. The oscillator CCO which is controlled in a current-dependent manner then starts with a predetermined lower limiting frequency and thus drives the selection circuit SEL, which activates the half-bridge circuit V2, V3 via the driver circuits HSD and LSD. The first internal current source IT begins to charge the external charging capacitor CT and activates the timer PST. The starting of the lamp begins with a preheating period $\Delta pt$. A corresponding, relatively low threshold value Mp for the preheating current is activated in the monitoring circuit MON. The monitoring circuit MON emits an output pulse QM each time this threshold value Mp is reached by a pulse of the load current. These output pulses in each case trigger the selection circuit SEL and activate the third internal current source ISC. As a result, the superordinate, i.e. second, regulating circuit—described in connection with the function of this current source ISC—for the current regulation is started. During this preheating period $\Delta pt$, the output of a signal amplifier QPT is switched off. This output can, for example, be used for controlling a preheating circuit or for setting a DC bias voltage at the control input of the monitoring circuit MON, for freely setting the preheating voltage.

In the further progression, the linearly rising input voltage of the timer PST reaches a predetermined preheating level. The preheating period $\Delta pt$ is concluded and the timer PST generates the first selection signal S1, which is output to the monitoring circuit MON and the signal amplifier QPT. A higher threshold value Mi for the ignition current of the fluorescent lamp FL is thus activated in the monitoring circuit MON; an ignition period Δit begins. Approximately at the same time, preferably immediately at the beginning of the ignition period Δit, the timer PST generates a further, the fourth, selection signal S4, whose trailing edge coincides with a maximum level of the input voltage of the timer PST being reached. With this fourth selection signal S4, the second internal current source IM is activated and, furthermore, a switch OPRd controlled after the manner of a flip-flop is enabled. In conjunction with a further threshold value Md activated in the monitoring circuit MON, for which threshold value the relationship $$Mp<Md<Mi$$

holds true, the monitoring circuit MON monitors the input signal which is fed to it, and is proportional to the load current, with regard to this threshold and, in a manner dependent thereon, supplies the further output pulses QM1. With each of these pulses, the abovementioned switch OPRd is initially set and in each case reset by the output signal of the selection circuit SEL. When the switch OPRd is switched on, ground potential is applied to the noninverting input of the regulating operational amplifier OPR, said input being connected to the external terminal P5. In this way, the limiting of the load current by the regulating operational amplifier OPR is deactivated for the duration of the ignition period Δit, that is to say the ignition voltage is not limited.

In the normal case, the fluorescent lamp FL ignites within a predetermined time after only a few ignition attempts. The peak value of the load current then automatically reverts to a normal operational value and, in the process, no longer reaches the threshold value Mi of the monitoring circuit MON; no further output pulses QM are generated.

The timer PST continues to run, however. Its rising input voltage initially passes through a predetermined ignition level and finally reaches a maximum level which initiates resetting of the timer PST. When this maximum level has been reached, the timer generates the output signal S3, which, on the one hand, activates a threshold value Mo in the monitoring circuit MON, which threshold value is not reached by the evaluated load current during normal lit operation of the fluorescent lamp FL; in other words no further output pulses QM are generated by it. On the other hand, the second internal current source IT assigned to the timer PST is switched off by the third selection signal S3. The charging capacitor CT connected to said second internal current source begins to discharge, that is to say the input signal fed to the timer PST falls to a constant level which is held during normal lit operation. However, as soon as the defined ignition period Δit has elapsed, the timer PST generates a further, the second, selection signal S2. The latter is held until the input signal of the timer PST passes through the ignition level again as it falls. This pulse duration of the second selection signal S2 defines a disconnection period Δst which follows the ignition period Δit and in which the disconnection of the electronic ballast is prepared in the event of a fault.

For the implementation of this function, a disconnection unit with a counter CTR and a disconnection circuit SDL is provided. The counter CTR is reset both by the rising edge and by the falling edge of the second selection signal S2. It is fed the output pulses QM of the monitoring circuit MON as counting pulses. In the event of a normal starting operation, it reaches its final value after four counting pulses, for example, and then activates the internal current source IT. In the further progression, the leading edge of the second selection signal S2 resets the counter CTR and preparatorily enables the disconnection circuit SDL. The number of vain ignition attempts or the number of output pulses QM that then occur is now counted. If the counter CTR reaches its final value in the case of a lamp that is reluctant to ignite, it activates the preparatorily enabled disconnection circuit SDL. The latter thereupon inhibits the selection circuit SEL, inter aila, and thereby interrupts the driving of the half-bridge circuit V2, V3. In an analogous manner, in the event of failure of the ignition of the fluorescent lamp FL during normal lit operation, the timer is activated again, renewed ignition attempts are evaluated in the monitoring circuit MON and output pulses QM are generated in the process. This again leads to the above-described disconnection of the electronic ballast after repeated vain ignition attempts. The hysteresis introduced by virtue of this measure suppresses momentary disturbances and leads to enhanced interference immunity of the electronic ballast.

For the sake of completeness, it shall be added that the control and regulating circuit IC is, finally, also designed for adaptation to changes in the load current in a relatively broad tolerance range. Such changes may occur in particular in the dimming state in the case of multi-lamp applications or else in the case of critical lamp tolerances, e.g. caused by aged, high-resistance lamp filaments. These situations can lead to the regulating operational amplifier OPR no longer operating within its defined regulating range. This state is detected by a further comparator COMP, which is connected to the external terminal P1 by its noninverting input and whose inverting input is fed an internally generated comparison voltage Vcc', which is reduced considerably, for example by 25%, compared with the voltage occurring in the normal operating state across the charging capacitor Ccc. If such an operating state occurs, the comparator COMP outputs a control signal to the monitoring circuit MON, which control signal sets, in said monitoring circuit, a state in which all the reference levels Mp, Mi, Mdo and Mo are considerably reduced. Therefore, the monitoring circuit MON then operates satisfactorily even at relatively low lamp currents.

What is claimed is:

1. A method for operating at least one fluorescent lamp (FL) by means of an electronic ballast with an integrated control and regulating circuit (IC) for regulating the load current in a load circuit (4) connected via a half-bridge circuit (V2, V3) and having the at least one fluorescent lamp (FL) by means of a drive circuit (CCO, SEL, HSD, LSD) of the half-bridge circuit, said drive circuit being regulated in a high-frequency manner, in which case, in the control and regulating circuit, comprising the steps of:

starting a timer (PST, IT, CT) for generating selection signals (S1, S2, S3, S4) each time the lamp is started and/or when there is a disturbance, wherein the selection signals define predetermined periods of time (Δpt, Δit, Δst, Δot), activating respectively different, predetermined reference levels (Mp, Mi, Mdo, and Mo) by means of the selection signals, in a monitoring circuit (MON) for the load current, emitting control pulses (QM) in the monitoring circuit as soon as the instantaneous value of the pulsed load current reaches the activated reference level, identifying by means of control pulses a normal state or a disturbance in the load circuit as a function of their occurrence or failure to occur during the present period of time (Δpt, Δit, Δst, or Δot) and, in the normal state, feeding as regulator actual values to the drive circuit (CCO, ISC, SEL, HSD, LSD) or, in the event of a disturbance, triggering an automatic disconnection of the electronic ballast, wherein, during the ignition period (Δit), the current signal which is derived from the load current and is fed to the monitoring circuit (MON) has superposed on it a DC signal (DC) which is generated internally in the control and regulating circuit (IC) and has a defined level, whose value is dimensioned in accordance with the types and/or circuits of the at least one fluorescent lamp which are used in the load circuit, with the result that the signal that is superposed in this way is adapted to the predetermined, fixed reference level (Mi) independently of the lamp selection in the load circuit.

2. The method as claimed in claim 1, wherein the DC signal (DC) superposed on the current signal to be detected is generated by a DC source (IM) which is provided internally in the control and regulating circuit (IC) and is held in the activated state for the period of time of the ignition period (Δit) by a further selection signal (S4) emitted by the timer (PST, IT, CT).

3. The method as claimed in claim 2, wherein the level of the internal DC source (IM) is set by the current flow through a resistor (RTL), which is connected externally to the drive circuit (CCO, SEL, HSD, LSD) of the half-bridge circuit (V2, V3), said drive circuit being regulated in a high-frequency manner, and determines a blanking interval in the half-bridge circuit.

4. The method as claimed in claim 1, wherein the regulation of the load current which is effected via the drive circuit (CCO, SEL, HSD, LSD) and the half-bridge circuit (V2, V3) connected thereto is deactivated during the ignition period (Δit) until the actual ignition instant of the at least one fluorescent lamp (FL).

5. An electronic ballast for operating at least one fluorescent lamp (FL) with a control and regulating circuit (IC) designed as an integrated circuit, to which there is connected, via a half-bridge circuit (V2, V3), a load circuit having the at least one fluorescent lamp for the regulation of the load current, in which case, in the control and regulating circuit, comprising:

a drive circuit (CCO, SEL, HSD, LSD), regulated in a high-frequency manner, for the half-bridge circuit (V2, V3), a timer (PST, IT, CT) which is to be started anew each time the lamp is started and/or when there is a disturbance, and serves for generating selection signals (S1, S2, S3), the sequence of which defines predetermined periods of time (Δpt, Δit, Δst, Δot) for example a preheating period (Δpt) or an ignition period (Δit), a monitoring circuit (MON) for the load current, which monitoring circuit is coupled to the half-bridge circuit, is designed as a threshold value comparator with a plurality of reference levels (Mp, Mi, Mdo, Mo) which are activated individually in each case by one of the selection signals, and generates a respective control pulse (QM) as soon as the pulsed load current reaches the instantaneously activated reference level, in which case these control pulses identify a normal state or a disturbance in the load circuit as a function of their occurrence or failure to occur during the present period of time (Δpt, Δit, Δst or Δto) and, in the normal state, are fed as regulator actual values to the drive circuit (CCO, ISC, SEL, HSD, LSD) or, in the event of a disturbance, trigger an automatic disconnection of the electronic ballast, wherein the control and regulating circuit (IC) furthermore has a DC source (IM), which is activated during the ignition period (Δit) until the actual ignition of the at least one fluorescent lamp (FL) and whose output is connected to the input of the monitoring circuit (MON) for the current signal derived from the load current and thus superposes on this load current signal a DC signal (DC) having a defined level, whose value is dimensioned according to the lamp types and/or circuits used in the load circuit.

6. The electronic ballast as claimed in claim 5, in which a non-reactive resistor (RTL) is connected externally to the drive circuit (CCO, SEL, HSD, LSD) for the half-bridge circuit (V2, V3), which resistor defines the blanking interval of these power transistors, wherein the level of the internal DC source (IM) is derived from the current flow through said resistor (RTL).

7. The electronic ballast as claimed in claim 5, wherein, in the control and regulating circuit (IC), provision is furthermore made of an inhibiting switch (OPRd), which deactivates the regulating circuit of the drive circuit (CCO, SEL, HSD, LSD) and hence regulation of the load current via the half-bridge circuit (V2, V3) connected thereto during the ignition period (Δit) until the actual ignition instant of the at least one fluorescent lamp (FL).

8. The electronic ballast as claimed in claim 7, wherein the monitoring circuit (MON) designed as a threshold value comparator is equipped with a further reference level (Mdo) in addition to the reference levels (Mp, Mi) for the load current during the preheating period (Δpt) and during the ignition period (Δit), respectively, the level of which further reference level is defined according to the relation $Mp<Mdo<Mi$ and, as a result, as soon as the signal which is derived from the load current and is fed to the input of the monitoring circuit exceeds said further reference level (Mop), said monitoring circuit respectively generates a further control pulse (QM1) which is fed to the inhibiting switch (OPRd) as a triggering pulse.

* * * * *